US011590786B2

(12) United States Patent
Hirokawa et al.

(10) Patent No.: US 11,590,786 B2
(45) Date of Patent: Feb. 28, 2023

(54) THERMAL TRANSFER SHEET

(71) Applicant: Dai Nippon Printing Co., Ltd., Tokyo (JP)

(72) Inventors: Junko Hirokawa, Tokyo (JP); Tadahiro Ishida, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 601 days.

(21) Appl. No.: 16/488,642

(22) PCT Filed: Feb. 28, 2018

(86) PCT No.: PCT/JP2018/007613

§ 371 (c)(1),
(2) Date: Aug. 26, 2019

(87) PCT Pub. No.: WO2019/003494

PCT Pub. Date: Jan. 3, 2019

(65) Prior Publication Data

US 2021/0138820 A1 May 13, 2021

(30) Foreign Application Priority Data

Jun. 26, 2017 (JP) ..... JP2017-124668

(51) Int. Cl.
*B41M 5/42* (2006.01)
*B41M 5/44* (2006.01)

(52) U.S. Cl.
CPC ..... *B41M 5/42* (2013.01); *B41M 5/423* (2013.01); *B41M 5/426* (2013.01); *B41M 5/44* (2013.01); *B41M 2205/06* (2013.01); *B41M 2205/30* (2013.01); *B41M 2205/38* (2013.01)

(58) Field of Classification Search
CPC ..... B41M 5/42; B41M 5/423; B41M 5/426; B41M 5/44; B41M 2205/06; B41M 2205/30; B41M 2205/38
See application file for complete search history.

(56) References Cited

U.S. PATENT DOCUMENTS 5,260,256 A 11/1993 Takahara et al.
7,651,976 B2 1/2010 Fukui et al.
2013/0142969 A1 6/2013 Yamashita et al.
(Continued)

FOREIGN PATENT DOCUMENTS

JP S61-268485 A1 11/1986
JP H04-135793 A1 5/1992
(Continued)

OTHER PUBLICATIONS

International Preliminary Report on Patentability (Chapter I) (Application No. PCT/JP2018/007613) dated Jan. 9, 2019.
(Continued)

*Primary Examiner* — Gerard Higgins
(74) *Attorney, Agent, or Firm* — Burr Patent Law, PLLC

(57) ABSTRACT

An object is to provide a thermal transfer sheet that can prevent the occurrence of layer detachment and has high transferability for preventing the occurrence of transfer defects such as delamination trace and tailing.
The thermal transfer sheet of the invention is characterized in that it includes a substrate, a release layer, and a transfer layer in that order, and the release layer contains at least one of alumina and alumina hydrate, and a binder resin.

10 Claims, 1 Drawing Sheet

(56) References Cited

U.S. PATENT DOCUMENTS

| | | | |
|---|---|---|---|
| 2015/0360497 | A1 | 12/2015 | Ishida et al. |
| 2017/0259601 | A1 | 9/2017 | Hayashi et al. |
| 2018/0222238 | A1 | 8/2018 | Yabe et al. |

FOREIGN PATENT DOCUMENTS

| | | | |
|---|---|---|---|
| JP | 2000-263589 | A | 9/2000 |
| JP | 2012-023044 | A1 | 2/2012 |
| JP | 2013-230665 | A1 | 11/2013 |
| JP | 2015-063086 | A1 | 4/2015 |
| JP | 2015-085688 | A1 | 5/2015 |
| JP | 2016-128211 | A1 | 7/2016 |
| JP | 2016-159507 | A1 | 9/2016 |
| JP | 2017-056587 | A | 3/2017 |
| JP | 2017-056728 | A1 | 3/2017 |
| JP | 2017-069176 | A1 | 4/2017 |
| KR | 10-2012-0062907 | A | 6/2012 |
| WO | 2016/043236 | A1 | 3/2016 |
| WO | 2016/159102 | A1 | 10/2016 |

OTHER PUBLICATIONS

International Search Report and Written Opinion (Application No. PCT/JP2018/007613) dated Apr. 17, 2018.

Korean Office Action (Application No. 10-2019-7031669) dated Jul. 1, 2021 (with English translation).

Extended European Search Report (Application No. 18823453.8) dated Mar. 11, 2021.

Korean Office Action (Application No. 10-2019-7031669) dated Dec. 28, 2021 (with English translation).

THERMAL TRANSFER SHEET

BACKGROUND OF THE INVENTION

Field of the Invention

The present invention relates to a thermal transfer sheet, and more precisely, a thermal transfer sheet including a substrate, a release layer, and a transfer layer.

Background Art

Conventionally, a thermofusible transfer process in which a colorant layer transfer sheet, including a substrate such as a resin film and a colorant layer containing a colorant, is subjected to applying energy using a thermal head or the like to transfer a colorant layer onto a transfer object such as paper or a plastic sheet to form an image, is known.

Because the image formed by the thermofusible transfer process is of high density and excellent to sharpness, the process is suitable for recording a binary image such as characters and line drawings. In addition, by the thermofusible transfer process, variable information such as addresses, customer information, numberings and bar codes can be recorded on a transfer object using a computer and thermal transfer printer.

In order to improve durability such as wear resistance of an image or the like which is formed as described above, a protective layer transfer sheet including a protective layer is superimposed on the image and energy is applied using a thermal head or the like, thereby transferring the protective layer.

Providing a release layer between a transfer layer such as a colorant layer or a protective layer and a substrate for the above-described thermal transfer sheet such as a colorant layer transfer sheet or a protective layer transfer sheet has been suggested (Patent Document 1). This allows adjusting delamination force between a transfer layer and a substrate or the like so as to prevent detachment due to delamination (so-called "layer detachment") of a transfer layer from a substrate or the like in a non-heating period during storage or the like.

However, conventional release layers have room for improvement because sufficient adhesion force between a transfer layer and a substrate or the like in a non-heating cannot be achieved, the occurrence of layer detachment cannot be completely prevented, and the delamination force in a heating period increases to an excessively high level, which prevents favorable transfer of a transfer layer and causes generation of delamination trace.

In addition to delamination trace, such thermal transfer sheets are required to have high transferability without causing the occurrence of transfer defects such as tailing during transfer of a transfer layer.

The term "tailing" according to the present invention refers to a phenomenon in which when a transfer layer is transferred onto a transfer object, the transfer layer is transferred starting from the boundary between a region in which the transfer layer is transferred and a non-transfer region such that the transfer layer extends from the boundary toward the non-transfer region side.

PRIOR ART REFERENCES

Patent Document

Patent Document 1: JP 2016-159507 A

SUMMARY OF THE INVENTION

Technical Problem

The present invention has been made in consideration of the above-described circumstances. A main object according to the present invention is to provide a thermal transfer sheet that can prevent the occurrence of layer detachment and has high transferability for preventing the occurrence of transfer defects such as delamination trace and tailing.

Solution to Problem

The thermal transfer sheet according to the present invention is characterized in that it comprises a substrate, a release layer, and a transfer layer in that order, and the release layer contains at least one of alumina and alumina hydrate, and a binder resin.

In an embodiment, the transfer layer includes a peeling layer.

In an embodiment, the peeling layer contains a wax.

In an embodiment, the transfer layer further includes a colorant layer on the peeling layer.

In an embodiment, a solid content ratio of the at least one of alumina and alumina hydrate to the binder resin (alumina or alumina hydrate/binder resin) is from 7/3 or more and 9/1 or less by mass.

In an embodiment, the binder resin is an aqueous resin.

In an embodiment, the aqueous resin is an aqueous vinyl resin.

In an embodiment, the aqueous vinyl resin is at least one of polyvinylpyrrolidone and vinyl acetate-vinylpyrrolidone copolymer.

In an embodiment, the transfer layer has a thickness of form 2 μm or more and 6 μm or less.

Advantageous Effects of Invention

According to the present invention, a thermal transfer sheet that can prevent the occurrence of layer detachment and has high transferability enabling prevention of the occurrence of transfer defects such as delamination trace and tailing.

DETAILED DESCRIPTION OF THE INVENTION (Thermal Transfer Sheet)

Figure 1:
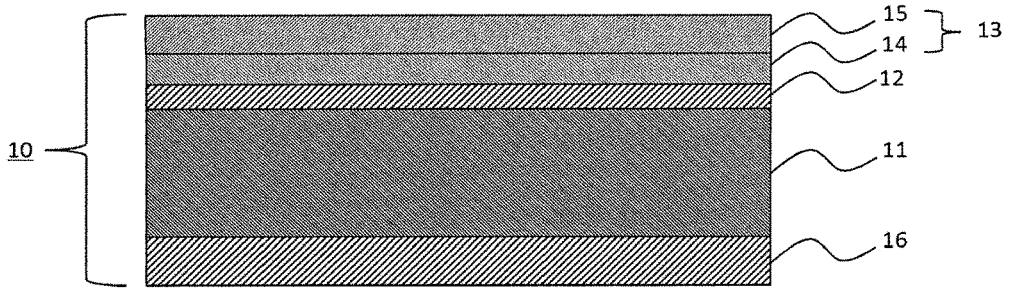
FIG. 1 is a schematic sectional view showing an embodiment of a thermal transfer sheet according to the present invention.

A thermal transfer sheet 10 according to the present invention includes a substrate 11, a release layer 12, and a transfer layer 13 in that order, as shown in FIG. 1.

In addition, in an embodiment, the transfer layer 13 includes a peeling layer 14 and a colorant layer 15, as shown in FIG. 1.

In an embodiment, the thermal transfer sheet 10 according to the present invention includes a back layer 16, as shown in FIG. 1.

Figure 2:
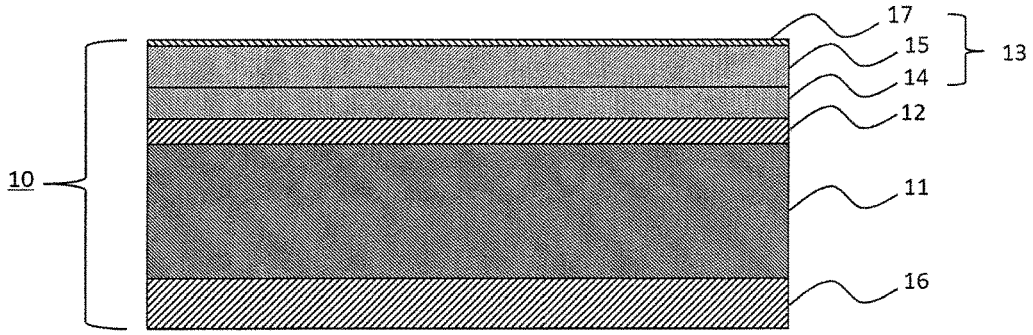
FIG. 2 is a schematic sectional view showing an embodiment of a thermal transfer sheet according to the present invention.

Further, in an embodiment, the transfer layer 13 includes an adhesive layer 17, as shown in FIG. 2.

Each layer constituting the thermal transfer sheet according to the present invention will be described below.

(Substrate)

The substrate can be employed, in particular, unlimitedly as long as it has heat resistance such that it is resistant under heat energy (e.g., heat generated by a thermal head) to be applied during thermal transfer and mechanical strength and solvent resistance such that it can support a transfer layer.

As a substrate, for example, films consisting of polyester-type resins such as polyethylene terephthalate (PET), polybutylene terephthalate (PBT), polyethylene naphthalate (PEN), polyethylene terephthalate-isophthalate copolymer, and terephthalic acid-cyclohexanedimethanol-ethylene glycol copolymer, polyamide-type resins such as nylon 6 and nylon 6,6, polyolefin-type resins such as polyethylene (PE), polypropylene (PP), and polymethylpentene, vinyl-type resins such as polyvinyl chloride, polyvinyl alcohol (PVA), polyvinyl acetate, vinyl chloride-vinyl acetate copolymer, polyvinyl butyral, and polyvinylpyrrolidone (PVP), (meth) acrylic-type resins such as polyacrylate, polymethacrylate, and polymethyl methacrylate, polyimide-type resins such as polyimide and polyether imide, styrene-type resins, cellulose-type resins such as cellophane, cellulose acetate, nitrocellulose, cellulose acetate propionate (CAP), and cellulose acetate butyrate (CAB) (hereinafter referred to as "resin films") can be employed.

Among the above-mentioned resins, from the viewpoint of heat resistance and mechanical strength, polyester-type resins such as PET and PEN are preferable, and PET is in particular preferable.

Noted that, in the present invention, the term "(meth) acrylic" encompasses both "acrylic" and "methacrylic."

A laminate of the above-mentioned resin films can be also employed as a substrate.

The laminate of the resin films can be produced by means of using dry lamination, wet lamination, extrusion and the like.

When the substrate is a resin film, the resin film may be a stretched film or an unstretched film, and a stretched film that is stretched uniaxially or biaxially is preferably employed from the viewpoint of strength.

In addition, from the viewpoints of the improvement of adhesiveness between the release layer and the back layer and the improvement of blocking resistance, the substrate preferably has irregularities on its surface.

As a means for forming irregularities on the substrate surface, for example, mat material kneading processing, sand blasting processing, hairline processing, mat coating processing, and chemical etching processing can be exemplified. Mat material kneading processing is a processing method for forming a substrate with a resin kneaded with an inorganic substance or an organic substance. Mat coating processing is a processing method for coating a substrate surface with a coating material containing an inorganic substance or an inorganic substance, thereby forming irregularities on the substrate surface.

A thickness of the substrate is preferably 3.0 μm or more and 12.0 μm or less, and more preferably 4.0 μm or more and 6.0 μm or less. When the thickness of the substrate is adjusted within such numerical ranges, it allows for excellent heat energy transfer during thermal transfer and excellent mechanical strength of the substrate.

(Release Layer)

The release layer is a layer which is provided between the substrate and the transfer layer and remains on the substrate side during thermal transfer.

The release layer provided to the thermal transfer sheet according to the present invention is characterized in that it contains at least one of alumina and alumina hydrate, and a binder resin, which makes it possible to improve the delamination force between the release layer and the transfer layer in a non-heating period, thereby preventing the occurrence of layer detachment. Further, it is possible to impart high transferability enabling prevention of the occurrence of transfer defects such as delamination trace and tailing to the thermal transfer sheet.

The release layer can be formed using a composition for forming the release layer which contains a dispersion liquid prepared by dispersing alumina in an appropriate solvent and a binder resin or a composition for forming the release layer which contains alumina sol and a binder resin. Specifically, the release layer can be formed in such a way that a composition for forming the release layer as described later is dispersed or dissolved in water or a suitable solvent, and the mixture is coated on the substrate by known means such as roll coating, reverse roll coating, gravure coating, reverse gravure coating, bar coating, and rod coating to form a coating film, and the film is then dried.

A solid content ratio of at least one of alumina and alumina hydrate, and a binder resin in the release layer is preferably 6/4 or more and 95/5 or less by mass, and more preferably 7/3 or more and 9/1 or less by mass.

By adjusting the solid content ratio of at least one of alumina and alumina hydrate, and a binder resin within such numerical ranges, it is possible to further prevent the occurrence of layer detachment and further improve transferability.

The term "alumina sol" used in the present invention refers to sol prepared by dispersing colloidal particles of alumina hydrate in an aqueous solvent. Here, alumina sol may contain non-hydrated aluminum oxide.

Examples of alumina hydrate include $Al(OH)_3$, $AlO(OH)$, and $Al_5O_7(OH)$.

In addition, examples of an aqueous solvent include water, hydrochloric acid, an aqueous acetic acid solution, an aqueous nitric acid solution, alcohol, and methyl isobutyl ketone.

The crystal structure of alumina hydrate is not particularly limited. Alumina hydrate having an arbitrary structure of boehmite crystal, pseudoboehmite crystal, amorphous crystal, or the like can be used. The crystal shape is also not particularly limited, and any shape such as a granular, rod-like, fibrous, or feather-like shape can be employed.

The primary particle size of colloidal particles of alumina hydrate is preferably from 2.0 nm or more and 30.0 nm or less, and more preferably 5.0 nm or more and 20.0 nm or less. By adjusting the primary particle size of colloidal particles of alumina hydrate within such numerical ranges, it is possible to further prevent the occurrence of layer detachment and further improve transferability.

The term "primary particle size" according to the present invention refers to a volume average particle size, which can be measured using a particle size analyzer for particle size distribution and concentration ratio analysis (Nanotrac particle size analyzer manufactured by Nikkiso Co., Ltd.) in accordance with MS Z 8819-2 (2001).

The solid content concentration of alumina sol is preferably 5% by mass or more and 20% by mass or less, and more preferably 7.5% by mass or more and 15% by mass or less.

By adjusting the solid content concentration of alumina sol within such numerical ranges, it is possible to further prevent the occurrence of layer detachment and further improve transferability.

The solid content concentration of alumina sol in the composition for forming the release layer is preferably 60% by mass or more and 95% by mass or less, and more preferably 70% by mass or more and 90% by mass or less with respect to the total solid content of the composition for forming the release layer (100% by mass). By adjusting the content of alumina sol within such numerical ranges, it is possible to further prevent the occurrence of layer detachment and further improve transferability.

Alumina sol can be prepared by a conventionally known method such as hydrolysis of aluminum alkoxide, neutralization of an aluminum salt with alkali, hydrolysis of aluminate, or the like.

Alumina sol is not limited to one prepared by such a method, and commercially available products of alumina sol can be used.

As the binder resin, an aqueous resin can be used.

The term "aqueous resin" according to the present invention refers to resins including a water-soluble resin that is soluble in an aqueous solvent or a resin that is insoluble in an aqueous solvent but can be dispersed in an aqueous solvent in a manner to form, for example, an emulsion or dispersion (hereinafter referred to as "water-dispersible resin"). Further, according to the present invention, such resins also include a resin that is a water-soluble resin or a water-dispersible resin and also soluble in an organic solvent.

The term "aqueous solvent" refers to water or a solvent containing water as a main component. Examples of a solvent that can be used with water in combination include, for example, alcohols such as methanol, ethanol, isopropanol, and n-propanol, glycols such as ethylene glycol and diethylene glycol, and ketones such as acetone and methyl ethyl ketone.

Examples of an aqueous resin include, for example, aqueous polyester-type resins, aqueous polyurethane-type resins, aqueous epoxy resins, aqueous (meth)acrylic-type resins, aqueous polyolefin-type resins, aqueous cellulose-type resins, aqueous vinyl-type resins, and aqueous (meth) acrylic-type resins.

In addition, the present invention is not limited to such resins, and casein, gelatin, agar, and starch, and the like may be used.

Examples of aqueous polyester-type resins include polyester-type resins having hydrophilic functional groups such as a hydroxyl group, a carboxyl group, an amino group, a carboxylic acid group, and a sulfonic acid group. More specific examples thereof include alcohol compounds such as ethylene glycol, propylene glycol, 1,3-butylene glycol, and dipropylene glycol polymerized with phthalic acid, phthalic anhydride, isophthalic acid, terephthalic acid, succinic acid, succinic anhydride, or the like.

Examples of aqueous polyurethane-type resins include isocyanate compounds such as hexamethylene diisocyanate, 2,2,4-trimethylhexamethylene diisocyanate, 1,4-cyclohexane diisocyanate, and xylylene diisocyanate polymerized with any of the above-described alcohol compounds.

Examples of aqueous epoxy resins include epoxy resins such as a bisphenol A epoxy resin and a bisphenol F epoxy resin which are forcibly emulsified using a surfactant and reaction products of epoxy resins and (meth)acrylic-type resins which are neutralized and dispersed using ammonia or the like.

Examples of aqueous (meth)acrylic-type resins include poly(meth)acrylic acid, 2-hydroxymethyl acrylate, and 2-hydroxyethyl acrylate.

Examples of aqueous polyolefin-type resins include resins obtained by copolymerizing ethylene with unsaturated carboxylic acids such as methacrylic acid, maleic acid, fumaric acid, itaconic acid, and crotonic acid under high temperature and pressure and neutralizing and dispersing the copolymers using ammonia, an amine compound, or the like.

Examples of aqueous cellulose-type resins include methyl cellulose, ethyl cellulose, carboxymethyl cellulose, hydroxypropyl cellulose, hydroxyethyl methyl cellulose, and hydroxypropyl methyl cellulose.

Examples of aqueous vinyl-type resins include PVP, vinyl acetate-vinylpyrrolidone copolymer, ethylene-vinyl acetate copolymer, PVA, polyvinyl acetal, polyvinyl acetate, and polyvinyl chloride.

Among the above-described resins, from the viewpoints of preventing layer detachment and improving transferability, aqueous vinyl-type resins are preferable, and PVP and vinyl acetate-vinylpyrrolidone copolymer are particularly preferable.

The solid content of the binder resin in the composition for forming the release layer is preferably 5% by mass or more and 40% by mass or less, and more preferably 10% by mass or more and 30% by mass or less with respect to the total solid content of the composition for forming the release layer (100% by mass). By adjusting the content of the binder resin within such numerical ranges, it is possible to further prevent the occurrence of layer detachment and further improve delamination properties.

Furthermore, in an embodiment, the release layer contains a releasing agent such as a silicone oil, a phosphate ester-based plasticizer, a fluorine-containing compound, wax, or metal soap.

The thickness of the release layer is preferably 0.01 μm or more and 0.5 μm or less, and more preferably 0.02 μm or more and 0.2 μm or less from the viewpoints of preventing layer detachment and improving transferability.

(Transfer Layer)

The thermal transfer sheet according to the present invention includes a transfer layer on the release layer, and the transfer layer includes at least one of a peeling layer, colorant layer, and an adhesive layer as mentioned above.

A thickness of the transfer layer is preferably 2 μm or more and 6 μm or less, and more preferably 3 μm or more and 5 μm or less. By adjusting the thickness of the transfer layer within such numerical ranges, it is possible to prevent the occurrence of layer detachment more effectively.

Further, when the transfer layer includes a colorant layer, it is possible to form a favorable image even on a transfer object having irregularities on its surface.

The delamination force of the transfer layer from the release layer at ordinary temperature (22° C.) is preferably 4 g/1.5 cm or more and 20 g/1.5 cm or less, and more preferably 6 g/1.5 cm or more and 15 g/1.5 cm or less. By adjusting the delamination force between the transfer layer and the release layer at ordinary temperature within such numerical ranges, it is possible to prevent the occurrence of layer detachment to a remarkable extent.

The delamination force between the transfer layer and the release layer according to the present invention is determined to be a value obtained by dividing delamination force (g) when removing the transfer layer from the release layer by the delamination width (cm). The delamination force between the transfer layer and the release layer can be measured when sticking a double-sided tape on the thermal transfer sheet and peeling off it in a 90° direction using a force gauge.

The delamination force between the transfer layer and the release layer at 40° C. is preferably 20 g/1.5 cm or more and 70 g/1.5 cm or less, and more preferably 30 g/1.5 cm or more and 50 g/1.5 cm or less. By adjusting the delamination force between the transfer layer and the release layer at 40° C. within such numerical ranges, it is possible to improve transferability of a thermal transfer sheet.

(Peeling Layer)

In an embodiment, the thermal transfer sheet according to the present invention includes a peeling layer disposed between the release layer and the colorant layer. The release layer is a layer that constitutes the transfer layer. Since the thermal transfer sheet has such a layer, transferability of the transfer layer can be improved.

In an embodiment, the peeling layer contains, for example, a cellulose-type resin, a vinyl-type resin such as ethylene-vinyl acetate copolymer, a polyurethane-type resin, a silicone-type resin, a (meth)acrylic-type resin such as ethylene-ethyl acrylate copolymer, a fluorine-type resin, or a wax.

Among these materials, the peeling layer preferably contains at least one of ethylene-vinyl acetate copolymer and ethylene-ethyl acrylate copolymer because the occurrence of layer detachment can be further prevented.

In addition, among these materials, the peeling layer contains preferably a wax, and more preferably a wax having a melting point or softening point of 70° C. or more and 120° C. or less because transferability of the thermal transfer sheet can be improved.

Examples of a wax include, for example, natural waxes such as beeswax, spermaceti wax, wood wax, rice bran wax, carnauba wax, candelilla wax, and montan wax, synthetic waxes such as silicone wax, paraffin wax, microcrystalline wax, oxidized wax, ozokerite, ceresin, ester wax, and polyethylene wax, higher saturated fatty acids such as margaric acid, lauric acid, myristic acid, palmitic acid, stearic acid, furoic acid, and behenic acid, higher saturated monohydric alcohols such as stearyl alcohol and behenyl alcohol, higher esters such as sorbitan fatty acid ester, and higher fatty acid amides such as stearic acid amide and oleic acid amide.

In addition, the peeling layer may contain a rubber such as isoprene rubber, butyl rubber, or nitrile rubber. Since the peeling layer contains a rubber, it is possible to enhance elasticity of the peeling layer and improve adhesiveness between the thermal transfer sheet and the transfer object.

The thickness of the peeling layer in a dry state is preferably 0.1 μm or more and 5.0 μm or less. By adjusting the thickness of the peeling layer within this numerical range, it is possible to improve transferability of the transfer layer. By adjusting the thickness of a dried coating within the above-described numerical range, it is possible to obtain favorable transfer sensitivity upon printing while preventing excessive adhesion between the release layer and the colorant layer and achieving favorable delamination effects.

The peeling layer can be formed by a conventionally known method such as hot melt coating, hot lacquer coating, gravure direct coating, gravure reverse coating, knife coating, air coating, or roll coating using a coating solution for forming the peeling layer.

(Colorant Layer)

The colorant layer is formed such that it contains a colorant and a binder resin.

A carbon black, an inorganic pigment, an organic pigment or a dye can be appropriately selected for use as a colorant included in the colorant layer according to requirement such as the color adjustment and the like. For example, it is preferable that a bar code printing have especially sufficient black density and do not discolor or fade in color due to light, heat and the like. Examples of such colorants include carbon blacks such as a lamp black, graphites, and nigrosin dyes. When color printing is required, another chromatic color dye or pigment is employed.

The content of the colorant in the colorant layer is preferably 20 parts by mass to 60 parts by mass, and more preferably 30 parts by mass or more and 50 parts by mass or less with respect to 100 parts by mass of the binder resin contained in the colorant layer.

Examples of the binder resin contained in the colorant layer include (meth)acrylic-type resins, polyolefin-type resins, vinyl-type resins, polyester-type resins, polyurethane-type resins, cellulose-type resins, amide-type resins, and phenol resins.

The content of the binder resin in the colorant layer is preferably 40% by mass or more and 80% by mass or less, and more preferably 50% by mass or more and 70% by mass or less.

In an embodiment, the colorant layer contains the above-described wax. The colorant layer may include additives such as a filler, plasticizer, an antistatic agent, and an ultraviolet absorber in a range that does not impair the characteristics according to the present invention.

The thickness of the colorant layer is preferably 0.5 μm or more and 2.0 μm or less, and more preferably 0.8 μm or more and 1.5 μm or less.

By adjusting the thickness of the colorant layer within such numerical ranges, it is possible to improve image formability on a transfer object having irregularities on its surface while maintaining transferability of the thermal transfer sheet.

The colorant layer can be formed in such a way that the above-mentioned materials are dispersed or dissolved in water or a suitable solvent, and the mixture is coated on the peeling layer or the like by known means such as roll coating, reverse roll coating, gravure coating, reverse gravure coating, bar coating, or rod coating to form a coating film, and the film is then dried.

(Adhesive Layer)

In an embodiment, the thermal transfer sheet according to the present invention includes an adhesive layer. As the thermal transfer sheet includes an adhesive layer, adhesion of the transfer layer to a transfer object can be improved.

The adhesive layer contains a thermoplastic resin which is softened by heating and exhibits adhesion properties.

Examples of a thermoplastic resin include polyester-type resins, vinyl-type resins such as vinyl chloride, vinyl acetate, and ethylene-vinyl acetate copolymer, (meth)acrylic-type resins, polyurethane-type resins, cellulose-type resins, melamine-type resins, polyamide-type resins, polyolefin-type resins, and styrene-type resins.

The thickness of the adhesive layer is preferably 0.1 μm or more and 0.6 μm or less, and more preferably 0.2 μm or more and 0.5 μm or less.

By adjusting the thickness of the adhesive layer within such numerical ranges, adhesiveness of the transfer layer to a transfer object can be improved while maintaining transferability of the thermal transfer sheet.

The adhesive layer can be formed in such a way that the above-mentioned materials are dispersed or dissolved in water or a suitable solvent, and the mixture is coated on the colorant layer or the like by known means such as roll coating, reverse roll coating, gravure coating, reverse gravure coating, bar coating and rod coating to form a coating film, and the film is then dried.

(Back Layer)

In an embodiment, the thermal transfer sheet according to the present invention includes a back layer on the side which is not provided with the transfer layer of the substrate. When the thermal transfer sheet includes a back layer, it allows for preventing the occurrence of sticking and/or wrinkling due to heating during thermal transfer.

In an embodiment, the back layer contains a binder resin. Examples of a binder resin include, for example, cellulose-type resins, styrene-type resins, vinyl-type resins, polyester-type resins, polyurethane-type resins, silicone-modified urethane-type resins, fluorine-modified urethane-type resins, and (meth)acrylic-type resins. Of these, the use of a styrene-type resin which is specifically styrene-acrylonitrile copolymer is preferable from the viewpoint of preventing burn-in of a thermal head and a back layer and generation of waste.

Furthermore, in an embodiment, the back layer includes as a binder resin a two-part curable resin which is hardened in combination with an isocyanate compound and/or the like. Examples of such a resin include polyvinyl acetal-type resins and polyvinyl butyral-type resins.

Conventionally known isocyanate compounds can be used as an isocyanate compound without particular limitations. However, it is desirable to use adducts of aromatic isocyanates among such compounds. Examples of aromatic polyisocyanates include a mixture of 2,4-toluene diisocyanate, 2,6-toluene diisocyanate, or 2,4-toluene diisocyanate with 2,6-toluene diisocyanate, 1,5-naphthalene diisocyanate, tolidine diisocyanate, p-phenylene diisocyanate, trans-cyclohexane-1,4-diisocyanate, xylylene diisocyanate, triphenylmethane triisocyanate, and tris(isocyanate phenyl) thiophosphate, and a mixture of 2,4-toluene diisocyanate, 2,6-toluene diisocyanate, or 2,4-toluene diisocyanate with 2,6-toluene diisocyanate is particularly preferable.

In an embodiment, the back layer contains inorganic or organic fine particles. When the back layer contains such fine particles, it allows for preventing the occurrence of sticking and/or wrinkling due to heating during thermal transfer.

Examples of the inorganic fine particles include inorganic fine particles composed of clay minerals such as talcs and kaolins, carbonate salts such as calcium carbonate and magnesium carbonate, hydroxides such as aluminum hydroxide and magnesium hydroxide, sulfates such as calcium sulfate, oxides such as silica, graphite, niter, and inorganic particles such as boron nitride.

Examples of the organic fine particles include organic fine particles composed of (meth)acrylic-type resins, teflon (registered trade name) resins, silicone-type resins, lauroyl-type resins, phenol-type resins, acetal-type resins, styrene-type resins, and polyamide-type resins, or crosslinked resin particles produced by reaction of these with a crosslinking agent.

The thickness of the back layer is preferably 0.01 μm or more and 0.5 μm or less, and more preferably 0.02 μm or more and 0.4 μm or less. By adjusting the thickness of the back layer within such numerical ranges, it is possible to prevent the occurrence of sticking and/or wrinkling maintaining ability of heat energy transfer during thermal transfer.

The back layer can be formed in such a way that the above-mentioned materials are dispersed or dissolved in water or a suitable solvent, and the mixture is coated on the substrate by known means such as roll coating, reverse roll coating, gravure coating, reverse gravure coating, bar coating and rod coating to form a coating film, and the film is then dried.

EXAMPLES

The present invention will now be described by means of examples, but the present invention is not to be limited to these examples. The compounding amount of each of the components of a coating solution for forming the release layer and a coating solution for colorant layer formation is expressed as a compounding amount that is not converted to a solid content.

Example 1

A coating solution for forming the back layer of the following composition was coated on one side of an untreated PET film having a thickness of 4.5 μm and dried to form a back layer having a thickness of 0.05 μm.

<Coating Solution for Forming the Back Layer>

| | |
|---|---|
| Silicone modified acrylic | 10 parts by mass |
| Methyl ethyl ketone (MEK) | 10 parts by mass |

Next, a coating solution for forming the release layer of the following composition was coated on the other side of the PET film on which the back layer was not formed and dried to form a release layer having a thickness of 0.1 μm.

<Coating Solution for Forming the Release Layer>

| | |
|---|---|
| Alumina sol (AS-200 manufactured by Nissan Chemical Corporation; solid content: 10%; primary particle size of colloidal particles: 10 nm) | 80 parts by mass |
| Vinyl acetate-vinylpyrrolidone copolymer (aqueous vinyl resin) (E-335 manufactured by ISP Japan Ltd.; solid content: 50%) | 4 parts by mass |
| Water | 40 parts by mass |
| Isopropanol (IPA) | 40 parts by mass |

A material for forming the peeling layer of the following composition was prepared and coated on the release layer formed as described above by hot melt coating and dried to form a peeling layer having a thickness of 3.0 μm.

<Coating Solution for Forming the Peeling Layer>

| | |
|---|---|
| Carnauba wax | 60 parts by mass |
| Paraffin wax | 40 parts by mass |

On the peeling layer formed as described above, a coating solution for forming the colorant layer of the following composition was coated and dried to form a colorant layer having a thickness of 1.0 μm, thereby obtaining a thermal transfer sheet.

<Coating Solution for Forming the Colorant Layer>

| | |
|---|---|
| Carbon dispersion solution (FUJI SP Black 8990 manufactured by Fuji Pigment Co., Ltd.; solid content: 31%) | 100 parts by mass |
| Carnauba wax (WE-95 manufactured by Konishi Co., Ltd.; solid content: 40%) | 180 parts by mass |

-continued

| | |
|---|---|
| Water | 40 parts by mass |
| IPA | 120 parts by mass |

Examples 2-4

The thermal transfer sheet was produced in the same way as in Example 1 except that the solid content ratio of alumina sol to vinyl acetate-vinylpyrrolidone copolymer in the release layer was changed as shown in Table 1.

Example 5

The thermal transfer sheet was produced in the same way as in Example 1 except that the composition of the coating solution for forming the release layer was changed as described below.

<Coating Solution for Forming the Release Layer>

| | |
|---|---|
| Alumina sol (AS-200 manufactured by Nissan Chemical Corporation; solid content: 10%; primary particle size of colloidal particles: 10 nm) | 80 parts by mass |
| Polyamide epoxy resin (aqueous epoxy resin) (Sumirez Resin (registered trademark) 675A manufactured by Sumitomo Chemical Co., Ltd.; solid content: 25%) | 8 parts by mass |
| Water | 50 parts by mass |
| IPA | 50 parts by mass |

Example 6

The thermal transfer sheet was produced in the same way as in Example 1 except that the composition of the coating solution for forming the release layer was changed as described below.

<Coating Solution for Forming the Release Layer>

| | |
|---|---|
| Alumina sol (AS-200 manufactured by Nissan Chemical Corporation; solid content: 10%; primary particle size of colloidal particles: 10 nm) | 80 parts by mass |
| Polyvinyl alcohol (PVA) (aqueous vinyl resin) (NH-18 manufactured by Nippon Synthetic Chemical Industry Co., Ltd.) | 2 parts by mass |
| Water | 50 parts by mass |
| IPA | 50 parts by mass |

Example 7

The thermal transfer sheet was produced in the same way as in Example 1 except that the composition of the coating solution for forming the release layer was changed as described below.

<Coating Solution for Forming the Release Layer>

| | |
|---|---|
| Alumina sol (AS-200 manufactured by Nissan Chemical Corporation; solid content: 10%; primary particle size of colloidal particles: 10 nm) | 80 parts by mass |

-continued

| | |
|---|---|
| Aqueous polyurethane-type resin (SUPERFLEX 650 manufactured by Daiichi Industrial Chemical Co. Ltd.; solid content: 26%) | 7.7 parts by mass |
| Water | 50 parts by mass |
| IPA | 50 parts by mass |

Example 8

The thermal transfer sheet was produced in the same way as in Example 1 except that the thickness of the peeling layer was changed to 1 μm, and the thickness of the transfer layer was changed to 1 μm.

Comparative Example 1

The thermal transfer sheet was produced in the same way as in Example 1 except that the composition of the coating solution for forming the release layer was changed as described below.

<Coating Solution for Forming the Release Layer>

| | |
|---|---|
| Alumina sol (AS-200 manufactured by Nissan Chemical Corporation; solid content: 10%; primary particle size of colloidal particles: 10 nm) | 100 parts by mass |
| Water | 50 parts by mass |
| IPA | 50 parts by mass |

Comparative Example 2

The thermal transfer sheet was produced in the same way as in Example 1 except that the composition of the coating solution for forming the release layer was changed as described below.

<Coating Solution for Forming the Release Layer>

| | |
|---|---|
| Vinyl acetate-vinylpyrrolidone copolymer (aqueous vinyl resin) (E-335 manufactured by ISP Japan Ltd.; solid content: 50%) | 10 parts by mass |
| Water | 100 parts by mass |
| IPA | 100 parts by mass |

Comparative Example 3

The thermal transfer sheet was produced in the same way as in Example 1 except that the composition of the coating solution for forming the release layer was changed as described below.

<Coating Solution for Forming the Release Layer>

| | |
|---|---|
| Polyester-type resin (VYLON (registered trademark) 200 manufactured by Toyobo Co., Ltd.) | 10 parts by mass |
| MEK | 100 parts by mass |
| Toluene (TOL) | 100 parts by mass |

Comparative Example 4

The thermal transfer sheet was produced in the same way as in Example 1 except that the composition of the coating solution for forming the release layer was changed as described below.

<Coating Solution for Forming the Release Layer>

| | |
|---|---|
| Cellulose acetate propionate (CAP) (CAP-482-20 manufactured by Eastman Chemical Company) | 10 parts by mass |
| MEK | 100 parts by mass |
| TOL | 100 parts by mass |

Comparative Example 5

The thermal transfer sheet was produced in the same way as in Example 1 except that the composition of the coating solution for forming the release layer was changed as described below.

<Coating Solution for Forming the Release Layer>

| | |
|---|---|
| (Meth)acrylic-type resin (DIANAL (registered trademark) BR-85 manufactured by Mitsubishi Chemical Corporation) | 10 parts by mass |
| MEK | 100 parts by mass |
| TOL | 100 parts by mass |

Comparative Example 6

The thermal transfer sheet was produced in the same way as in Example 1 except that the composition of the coating solution for forming the release layer was changed as described below.

<Coating Solution for Forming the Release Layer>

| | |
|---|---|
| Colloidal silica (ST-OL manufacture by (Nissan Chemical Corporation; solid content: 20%) | 100 parts by mass |
| Water | 50 parts by mass |
| IPA | 50 parts by mass |

Comparative Example 7

The thermal transfer sheet was produced in the same way as in Example 1 except that the composition of the coating solution for forming the release layer was changed as described below.

<Coating Solution for Forming the Release Layer>

| | |
|---|---|
| Colloidal silica (ST-OL manufacture by (Nissan Chemical Corporation; solid content: 20%) | 40 parts by mass |
| Vinyl acetate-vinylpyrrolidone copolymer (aqueous vinyl resin) (E-335 manufactured by ISP Japan Ltd.; solid content: 50%) | 4 parts by mass |
| Water | 40 parts by mass |
| IPA | 40 parts by mass |

Comparative Example 8

The thermal transfer sheet was produced in the same way as in Example 1 except that the release layer was not formed.

<<Layer Detachment Prevention Ability Test>>

The thermal transfer sheets prepared in the above-described Examples and Comparative Examples were each wound up to obtain a ribbon roll.

Each ribbon was separately fed using an actual printer (1-4308 manufactured by DATAMAX) at 5° C. in a 20 RH % environment. It was visually confirmed whether abnormal delamination (peel-off) of the transfer layer from the ribbon during feeding occurred, and an evaluation was made according to the evaluation criteria described below.

(Evaluation Criteria)

A: No peel-off of the transfer layer

NG: Peel-off of the transfer layer observed

<<Delamination Test>>

A black solid image was printed using each of the thermal transfer sheets produced in the above-described Examples and Comparative Examples and, as a transfer object, a white coat paper label (Fasson 1C manufactured by Avery Dennison Corporation).

For image printing, an actual printer (1-4308 manufactured by DATAMAX) was used at a printing speed of 203.2 mm/sec (8 IPS) and a printing energy of 12.

It was visually confirmed whether delamination trace occurred during printing in the manner described above, and an evaluation was made according to the evaluation criteria described below.

(Evaluation Criteria)

A: No occurrence of delamination trace or tailing

B: Occurrence of delamination trace and tailing to some extent

NG: Occurrence of delamination trace

<<Delamination Force Test>>

Transparent double-sided tape (NW-T15 manufactured by Nichiban Co., Ltd.) having a width of 1.5 cm was applied to a heating place, and each of the thermal transfer sheets having the same width produced in Example 1 and Comparative Example 3 described above was separately attached thereto with the colorant layer down such that the thermal transfer sheet was bonded thereto. The heating plate was adjusted to ordinary temperature (22° C.), and the thermal transfer sheet was removed at 90° from the transparent double-sided tape using a digital force gauge (DPX-5 manufactured by IMADA Co., Ltd.). The value obtained by dividing the load (g) at that time by the delamination width (1.5 cm) was measured as the delamination force. The measurement results are shown in Table 1. As shown in Table 1, the delamination force of the transfer layer when removed from the thermal transfer sheet prepared in Example 1 was 4 g/1.5 cm or more, indicating that the transfer layer was sufficiently retained at ordinary temperature.

In addition, the delamination force of the transfer layer when the temperature of the heating plate was set to 30° C. and 40° C. was also measured in the same manner, and the results are shown in Table 1. It was found that each of the delamination force of the transfer layer when removed from the thermal transfer sheet prepared in the Examples was not more than 12 g/1.5 cm at 30° C. and not more than 40 g/1.5 cm at 40° C., and therefore, the delamination force did not excessively increase.

<<Image-Forming Ability>>>

Figure 3:
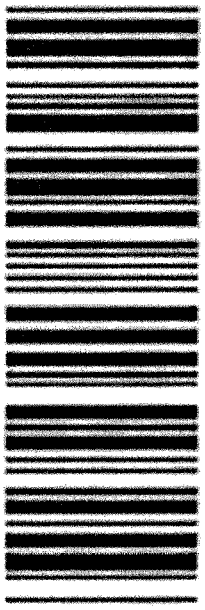
FIG. 3 is a ladder barcode printed in the image-forming ability test in Examples.

A ladder barcode shown in FIG. 3 was printed using each the thermal transfer sheets produced in the above-described Examples and Comparative Examples and, as a transfer object, a white coat paper label (Fasson 1C manufactured by Avery Dennison Corporation).

For printing, an actual printer (1-4308 manufactured by DATAMAX) was used at a printing speed of 203.2 mm/sec (8 IPS) and a printing energy of 12.

It was visually confirmed whether tailing in the print obtained as described above occurred, and an evaluation was made according to the evaluation criteria described below using a bar code checker (manufactured by Honeywell International. Inc, Quick Check 850).

(Evaluation Criteria)

A: The judgment result by bar code checker was A or B without problems of transferability.

B: Although transfer defects such as tailing occurred to a slight extent, the judgment result by bar code checker was C or D without problems in practical use.

NG: Transferability was insufficient, and the judgment result by bar code checker was F or impossible.

-: Due to "NG" in terms of layer detachment prevention ability, printing was impossible, and an evaluation could not be made.

TABLE 1

| | Solid composition of release layer (% by mass) | | | | | | | |
|---|---|---|---|---|---|---|---|---|
| | Alumina sol | Aqueous vinyl-type resin | Aqueous polyester-type resin | Aqueous epoxy resin | Polyurethane-type resin | Cellulose-type resin | (Meth) acrylic-type resin | Colloidal silica |
| Example 1 | 80 | 20 | | | | | | |
| Example 2 | 90 | 10 | | | | | | |
| Example 3 | 70 | 20 | | | | | | |
| Example 4 | 50 | 50 | | | | | | |
| Example 5 | 80 | | | 20 | | | | |
| Example 6 | 80 | 20 | | | | | | |
| Example 7 | 80 | | | | 20 | | | |
| Example 8 | 80 | 20 | | | | | | |
| Comparative Example 1 | 100 | | | | | | | |
| Comparative Example 2 | | 100 | | | | | | |
| Comparative Example 3 | | | 100 | | | | | |
| Comparative Example 4 | | | | | | 100 | | |
| Comparative Example 5 | | | | | | | 100 | |
| Comparative Example 6 | | | | | | | | 100 |
| Comparative Example 7 | | 20 | | | | | | 80 |
| Comparative Example 8 | | | | No release layer | | | | |

| | Thermal transfer sheet performance evaluation | | | | | | |
|---|---|---|---|---|---|---|---|
| | Transfer layer thickness (μm) | Layer detachment prevention ability | Delamination properties | Delamination force (g/1.5 cm) | | | Image formability |
| | | | | Ordinary temperature | 30° C. | 40° C. | |
| Example 1 | 3 | A | A | 4 | 12 | 40 | A |
| Example 2 | 3 | A | A | | | | A |
| Example 3 | 3 | A | A | | | | A |
| Example 4 | 3 | A | B | | | | A |
| Example 5 | 3 | A | A | | | | A |
| Example 6 | 3 | A | A | | | | A |
| Example 7 | 3 | A | A | | | | A |
| Example 8 | 1 | A | A | | | | B |
| Comparative Example 1 | 3 | A | A | | | | NG |
| Comparative Example 2 | 3 | A | NG | | | | B |
| Comparative Example 3 | 3 | NG | NG | 2 | 45 | 84 | — |
| Comparative Example 4 | 3 | A | NG | | | | B |
| Comparative Example 5 | 3 | NG | NG | | | | — |
| Comparative Example 6 | 3 | NG | A | | | | — |
| Comparative Example 7 | 3 | NG | A | | | | — |
| Comparative Example 8 | 3 | NG | A | | | | — |

REFERENCE SIGNS LIST

10: Thermal transfer sheet
11: Substrate
12: Release layer
13: Transfer layer
14: Peeling layer
15: Colorant layer
16: Back layer
17: Adhesive layer

The invention claimed is:

1. A thermal transfer sheet, comprising:
a substrate;
a release layer; and
a transfer layer, in that order,
wherein the release layer contains at least one of alumina and alumina hydrate, and a binder resin,
wherein a solid content ratio of the at least one of alumina and alumina hydrate to the binder resin (alumina or alumina hydrate/binder resin) is from 7/3 or more and 9/1 or less by mass, and
wherein the transfer layer includes a peeling layer.

2. The thermal transfer sheet according to claim 1, wherein the peeling layer contains a wax.

3. The thermal transfer sheet according to claim 1, wherein the transfer layer further includes a colorant layer on the peeling layer.

4. The thermal transfer sheet according to claim 1, wherein the binder resin is an aqueous resin.

5. The thermal transfer sheet according to claim 4, wherein the aqueous resin is an aqueous vinyl resin.

6. The thermal transfer sheet according to claim 5, wherein the aqueous vinyl resin is at least one of polyvinylpyrrolidone and vinyl acetate-vinylpyrrolidone copolymer.

7. The thermal transfer sheet according to claim 1, wherein the transfer layer has a thickness of 1 μm or more and 6 μm or less.

8. The thermal transfer sheet according to claim 1, which is a thermofusible transfer sheet.

9. The thermal transfer sheet according to claim 1, wherein a delamination force between the transfer layer and the release layer at 22° C. is in a range of 4 gf/1.5 cm or more to 20 gf/1.5 cm or less.

10. The thermal transfer sheet according to claim 1, wherein a delamination force between the transfer layer and the release layer at 40° C. is in a range of 20 gf/1.5 cm or more to 70 gf/1.5 cm or less.

* * * * *